US010557230B2

(12) United States Patent
Maziere et al.

(10) Patent No.: US 10,557,230 B2
(45) Date of Patent: Feb. 11, 2020

(54) IRONING MACHINE

(71) Applicant: ELECTROLUX LAUNDRY SYSTEMS FRANCE, Rosieres Pres Troyes (FR)

(72) Inventors: André Maziere, Rosieres Pres Troyes (FR); Oscar Mayeur, Rosieres Pres Troyes (FR)

(73) Assignee: Electrolux Laundry Systems France, Rosieres Pres Troyes (FR)

( * ) Notice: Subject to any disclaimer, the term of this patent is extended or adjusted under 35 U.S.C. 154(b) by 48 days.

(21) Appl. No.: 15/980,048

(22) Filed: May 15, 2018

(65) Prior Publication Data

US 2018/0355550 A1 Dec. 13, 2018

(30) Foreign Application Priority Data

Jun. 9, 2017 (EP) ..... 17305692

(51) Int. Cl.
*D06F 67/08* (2006.01)
*D06F 65/06* (2006.01)
*D06F 67/02* (2006.01)

(52) U.S. Cl.
CPC ..... *D06F 67/08* (2013.01); *D06F 65/06* (2013.01); *D06F 67/02* (2013.01)

(58) Field of Classification Search
CPC ..... D06F 67/00; D06F 67/02; D06F 67/10; D06F 67/08; D06F 65/00; D06F 65/10;
(Continued)

(56) References Cited

U.S. PATENT DOCUMENTS 2,038,363 A * 4/1936 Ingersoll ..... B23K 20/227 38/63
3,788,106 A * 1/1974 True ..... D06B 11/0076 68/5 D (Continued)

FOREIGN PATENT DOCUMENTS

WO WO 2004035907 A1 * 4/2004

*Primary Examiner* — Ismael Izaguirre
(74) *Attorney, Agent, or Firm* — Pearne & Gordon LLP

(57) ABSTRACT

A ironing machine (1) comprising: an axially-rotatable ironing drum (4); a motor assembly adapted to drive the ironing drum (4) into rotation about the drum longitudinal axis (A); an ironing chest (7) which is arranged adjacent to the ironing drum (4), locally substantially parallel to the peripheral surface (4*p*) of said ironing drum (4); a supporting assembly (9) adapted to keep the ironing drum (4) and the ironing chest (7) adjacent to one another; and an induction device (10) which is located adjacent to the ironing chest (7) and is adapted to heat up, via electromagnetic induction, the ironing chest (7); said ironing chest (7) comprising a platelike member (13) which extends beside the ironing drum (4), is substantially C-bent so as to extend locally substantially parallel to the peripheral surface (4*p*) of said ironing drum (4), and has a multilayer structure that includes: a main supporting sheet (14) which is substantially C-bent and is made of a metal material having a given thermal conductivity; and a ferromagnetic layer (15) which covers the convex face of said main supporting sheet (14), and is made of a ferromagnetic metal material having a thermal conductivity lower than that of the metal material forming said main supporting sheet (14).

15 Claims, 3 Drawing Sheets

(58) Field of Classification Search
CPC ..... D06F 69/00; D06F 69/02; D06F 69/04; D06F 61/00; D06F 63/00; D06F 63/02; H05B 6/00; H05B 6/62
See application file for complete search history.

(56) References Cited

U.S. PATENT DOCUMENTS

| | | | | |
|---|---|---|---|---|
| 4,675,487 | A * | 6/1987 | Verkasalo | D21F 5/024 100/327 |
| 5,438,776 | A * | 8/1995 | Lapauw | D06F 67/08 38/47 |
| 2001/0015026 | A1* | 8/2001 | Grandpierre | D06F 65/02 38/66 |
| 2008/0118855 | A1* | 5/2008 | Nakayama | G03G 9/0819 430/109.4 |
| 2008/0181642 | A1* | 7/2008 | Kishi | G03G 15/2042 399/69 |
| 2011/0052281 | A1* | 3/2011 | Gon | G03G 15/2014 399/329 |

* cited by examiner

IRONING MACHINE

The present invention relates to an ironing machine.

More in detail, the present invention relates to a professional chest ironer, to which the following description specifically refers purely by way of example and without this implying any loss of generality.

As is known, chest ironers are commonly used for dying and ironing single or double sheets, towels and other laundry items with relatively large surfaces, and are widely used in hotels, laundries and similar professional applications.

These professional chest ironers basically comprise: a generally horizontally-arranged, cylindrical ironing drum usually having a hollow structure and a perforated peripheral wall; a motor assembly capable of driving the ironing drum into rotation about the drum longitudinal axis; a platelike ironing chest which extends next to the ironing drum, parallel to the longitudinal axis of the drum, and is additionally C-bent so as to also extend locally substantially tangent to a nearly hemicylindrical longitudinal strip of the peripheral surface of the ironing drum; a supporting assembly capable of supporting and pressing the ironing chest against the peripheral wall of the ironing drum; and heating means capable of selectively heating up the ironing chest to a temperature generally ranging between 100° to 200° Celsius.

In use, the rotating ironing drum drags by friction the laundry item to be ironed into and along the nearly hemicylindrical gap delimited by the ironing chest and the ironing drum while at same time the ironing chest is heated and pressed against the ironing drum, so that the laundry item coming out of the hemicylindrical gap is both dried and ironed due to the high temperature of the ironing chest and to the friction against the concave surface of the same chest.

The chest may be heated e.g. by electrical resistance or by circulation of hot steam or fluid within channels of the chest. The chest may alternatively be heated by means of a gas burner acting on a convex side of the chest.

A further possible way of heating the chest is electromagnetic induction; in this case the professional chest ironer may additionally include: an electrical conductor which is shaped so as to form one or more induction coils that are arranged immediately adjacent to the convex surface of the ironing chest, i.e. on the opposite side of the ironing drum; and an electric power unit that circulates along the electrical conductor an alternating current with a frequency preferably ranging between 20.000 Hz to 40.000 Hz, so that the induction coils generate a high-frequency electromagnetic field that affects the ironing chest. This high-frequency electromagnetic field, in turn, generates into the body of the ironing chest, via electromagnetic induction, high-frequency Eddy currents (also called Foucault currents) that quickly heat up the whole ironing chest via Joule heating.

A chest ironer heated by electromagnetic induction is shown in the PCT application n. WO2016180489, disclosing a chest ironer comprising a chest, a cylinder, displacement means for displacement of the chest and the cylinder relatively each other, and rotation means for rotation of the cylinder around an axis of rotation. The chest comprises a curved metal plate with a concave side which faces the cylinder and a convex side. The chest ironer further comprises at least one induction arrangement for heating of the metal chest. The induction arrangement comprises at least one electrical conductor arranged electrically isolated from the chest at the convex side of the chest, the at least one electrical conductor being connectable to a high frequency power source.

Induction heating has the big advantage of heating up the ironing chest very quickly, but has also some drawbacks that so far have hindered its application in this field.

In fact, induction heating requires the use in the chest of a material having a relatively-high magnetic-permeability, so as to generate effective Eddy currents, but that at the same time allows the chest to remain flexible enough for matching the shape of the drum during the pressing, and which avoids the risk of cold or hot spots on the ironing chest which could compromise the ironing and/or risk of damaging the item to be ironed.

Applicant has not been able to find single a material fulfilling all above requirements, at least a material having a cost which allows to be applied industrially in this field.

Aim of the present invention is to solve the drawbacks of the cited prior ironer having a chest heated by electromagnetic induction.

A non-limiting embodiment of the present invention will now be described, by way of example, with reference to the accompanying drawings, in which.

Figure 1:
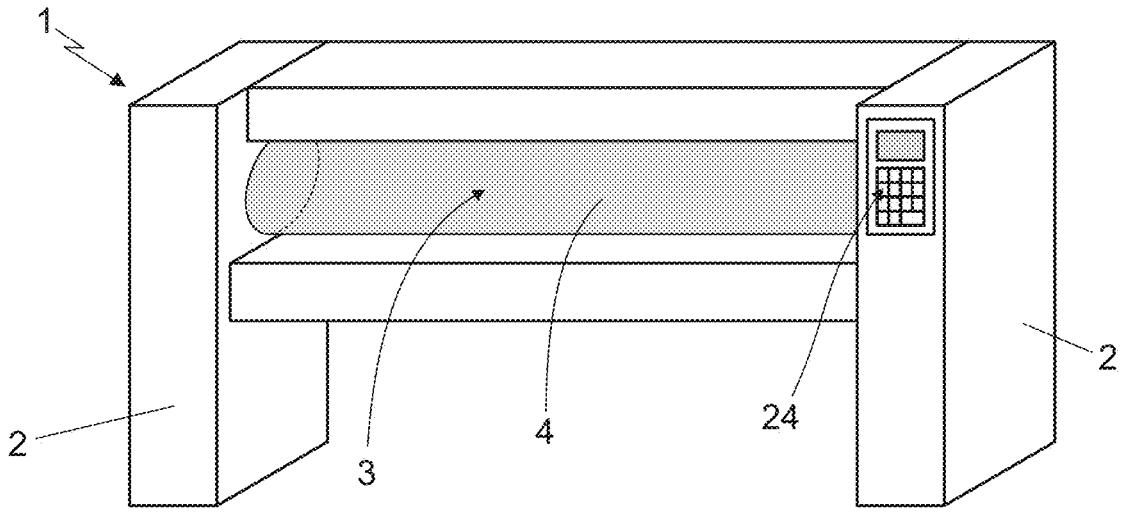
FIG. 1 is a simplified perspective view of an ironing machine in accordance with the teachings of the present invention.

Reference number 1 denotes as a whole an ironing machine preferably suitable for professional use.

The ironing machine 1 preferably basically comprises: an outer casing 2, preferably substantially gantry-shaped and boxlike, which is preferably made of metal material, and is structured for stably resting on the floor; and an ironing assembly 3 which is at least partially recessed/housed into the outer casing 2, and is suitably structured for ironing, and preferably drying, laundry items 100 with relatively large dimensions/surfaces, such as for example single or double sheets and towels.

The ironing assembly 3 preferably comprises: a substantially cylindrical ironing drum 4 which extends coaxial to a preferably substantially horizontally-oriented, longitudinal axis A, and which preferably has a hollow structure and optionally also a steam-permeable peripheral wall 5; a motor assembly (not shown in the figures) which is adapted to selectively drive the ironing drum 4 into rotation about its longitudinal axis A; an ironing chest 7 which has a concave outer surface 7*c* at least partially complementary in shape to the peripheral surface 4*p* of the ironing drum 4, and is arranged adjacent to the ironing drum 4, with the outer surface 7*c* locally substantially parallel to the peripheral surface 4*p* of the ironing drum 4, so as to delimit, together with the ironing drum 4, an in-between gap 8; and a supporting assembly 9 structured for keeping the ironing drum 4 and the ironing chest 7 adjacent to one another preferably allowing at same time a limited reciprocal displacement of the two components.

Preferably the supporting assembly 9 is furthermore structured for selectively pressing the ironing chest 7 against the peripheral surface 4*p* of the ironing drum 4 or vice versa.

More in detail, the ironing drum 4 is preferably coupled to the outer casing 2 in axially rotatable manner. The supporting assembly 9 in turn is preferably interposed between the outer casing 2 and the ironing chest 7, and is structured to elastically support the ironing chest 7 so as to allow the displacement of ironing chest 7 with respect to ironing drum 4 in a nearly radial (with respect to the drum 4) direction.

In addition to the above, the ironing assembly 3 comprises an induction device 10 which is advantageously located adjacent to the ironing chest 7, preferably on the opposite side of ironing drum 4, and is adapted to selectively heat up, via electromagnetic induction, the ironing chest 7 to a given ironing temperature and preferably also to continuously keep the same ironing chest 7 at said ironing temperature. Preferably this ironing temperature is moreover higher than 90° Celsius and more preferably, though not necessarily, also ranging between 100° to 200° Celsius.

More in detail, the induction device 10 is structured to selectively generate a high-frequency variable electromagnetic field that affects the ironing chest 7, so as to produce inside the ironing chest 7, via electromagnetic induction, high-frequency Eddy currents (also called Foucault currents) that quickly heat up the whole ironing chest 7 via Joule heating.

The ironing drum 4 is preferably recessed into the outer casing 2 so that a, preferably nearly hemicylindrical, longitudinal sector of the peripheral surface 4*p* of the ironing drum 4 is directly exposed to the outside.

Preferably, the ironing drum 4 basically comprises: a substantially cylindrical, rigid inner tubular member 11 which is preferably made of metal material, such as stainless steel, and preferably has a perforated peripheral wall; and a substantially cylindrical, outer protective padding 12 which substantially completely covers the outer surface of the peripheral wall of the tubular member 11, and is preferably made of a steam-permeable material of known type.

The motor assembly (not shown in the figures), in turn, preferably includes an electric motor which is mechanically connected in known manner to the ironing drum 4, or better to the inner tubular member 11 of ironing drum 4, for selectively driving the ironing drum 4 into rotation about its longitudinal axis A, with a preferably variable, rotating speed w.

The ironing chest 7 preferably comprises an oblong platelike member 13 which extends next to/beside the ironing drum 4, parallel, or substantially parallel to longitudinal axis A, and is advantageously C-bent, so as to extend locally at least partially locally parallel to the peripheral surface 4*p* of the ironing drum 4. In other words the platelike member 13 is preferably at least partially substantially hemicylindrical in shape.

The concave face of platelike member 13 therefore forms the concave outer surface 7*c* of ironing chest 7.

The platelike member 13 furthermore has a multilayer structure.

The multilayer structure preferably comprises: a main supporting sheet 14 which is preferably C-bent, or substantially C-bent, so as to extends at least partially locally parallel to the peripheral surface 4*p* of ironing drum 4, and is made of a first metal material having a thermal conductivity preferably higher than 230 W/(m·K) (watts per meter-kelvin). Preferably, said first metal material is moreover a diamagnetic or paramagnetic metal material.

The multilayer structure preferably also comprises a ferromagnetic layer 15 which covers the convex face of supporting sheet 14, and is made of a ferromagnetic second metal material which has a thermal conductivity lower than that of the metal material forming the main supporting sheet 14. Preferably, the multilayer structure also comprises a protective surface film 16 which preferably substantially completely covers the concave face of supporting sheet 14, and is made of an abrasion- and/or corrosion-resistant coating material.

It is underlined that a material is defined as ferromagnetic if it has a relative permeability $\mu_r$ significantly greater than 1. For a magnetic stainless steel $\mu_r$ generally ranges from 1000 to 1800. In our case a ferromagnetic material is preferably intended to have a relative permeability $\mu_r$ at least greater than 100.

Supporting sheet 14 is preferably at least 1 mm (millimetres) thick, and is preferably made of aluminium or aluminium alloys having a thermal conductivity preferably roughly equal to or higher than 230 W/(m·K) (watts per meter-kelvin).

In the example shown, in particular, supporting sheet 14 is preferably made of Aluminium 1050. Furthermore, thickness of supporting sheet 14 preferably ranges between 1 and 8 mm (millimetres).

Preferably, the metal material forming the ferromagnetic layer 15 has a thermal conductivity which is at least 50% lower than that of the metal material forming the supporting sheet 14, and/or is lower than 100 W/(m·K) (watts per meter-kelvin).

Preferably, but not necessarily, the thickness of ferromagnetic layer 15 is lower than that of supporting sheet 14.

The thickness of ferromagnetic layer 15 is preferably at least 50% lower than that of supporting sheet 14.

Furthermore, the ferromagnetic layer 15 is preferably made of AISI 430 stainless steel or other ferromagnetic metal alloy preferably having a thermal conductivity ranging between 15 and 50 W/(m·K) (watts per meter-kelvin).

Preferably, though not necessarily, the ferromagnetic layer 15 is formed/realized directly onto the convex face of supporting sheet 14 via a cold-gas dynamic-spray deposition process, also called cold-spray deposition process.

In other words, solid particles of the metal material forming the ferromagnetic layer 15, preferably having a nominal diameter between 1 to 50 μm (micrometers), are rapidly accelerated inside a converging-diverging nozzle up to a velocity preferably ranging between 500 and 800 m/s (meters per seconds) and are then directed straight towards the supporting sheet 14. On impact with the supporting sheet 14, these solid particles undergo a plastic deformation so as to permanently fit and adhere to the surface of the supporting sheet 14.

Figure 6:
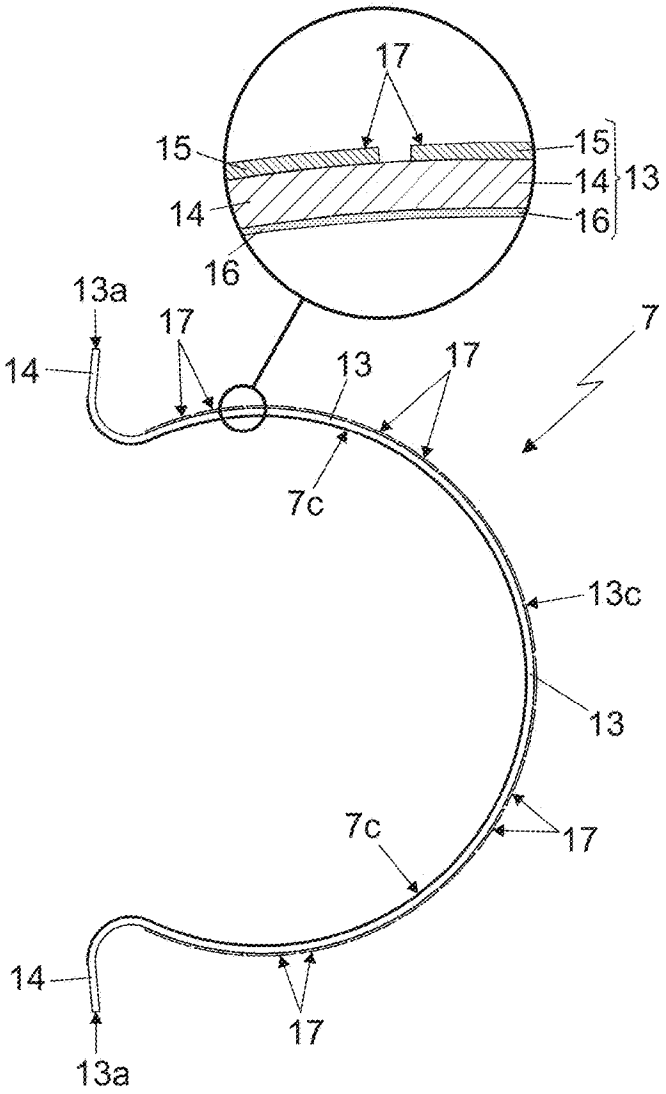
FIGS. 5 and 6 are, respectively, a simplified perspective view and a simplified side view of the ironing chest of the ironing assembly shown in FIGS. 2 to 4, with parts removed for clarity.
Figure 5:
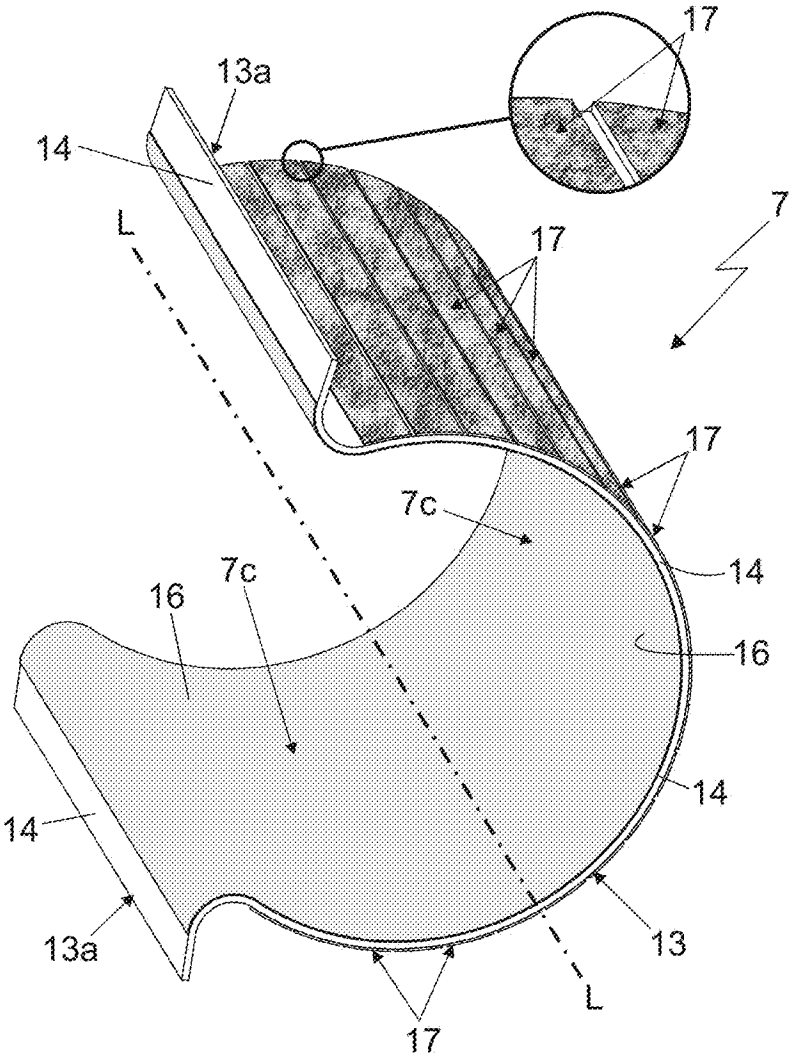

In addition to the above, as shown for example in FIGS. 5 and 6, preferably the ferromagnetic layer 15 includes/consists of a series of discrete and reciprocally spaced, longitudinal ferromagnetic stripes or splints 17 preferably of constant thickness and/or width, which are made of said ferromagnetic metal material having a thermal conductivity lower than that of the metal material forming the main supporting sheet 14.

Preferably, ferromagnetic stripes or splints 17 extend on the convex face of supporting sheet 14 spaced side-by-side to one another and preferably also substantially parallel to the longitudinal axis L of the C-bent oblong platelike member 13, preferably for the whole length of the same platelike member 13.

The spaced positioning of the stripes or splints 17 allows a certain degree of thermal compensation and ensures a good mechanical flexibility of the platelike member 13.

The longitudinal axis L of the C-bent platelike member 13 is substantially parallel to the longitudinal axis A of ironing drum 4.

The protective film 16 on the concave face of supporting sheet 14 is preferably obtained by anodizing the surface of the concave face of said supporting sheet 14, so as to increase the thickness of the oxide layer naturally forming on surface of the same supporting sheet 14.

Figure 2:
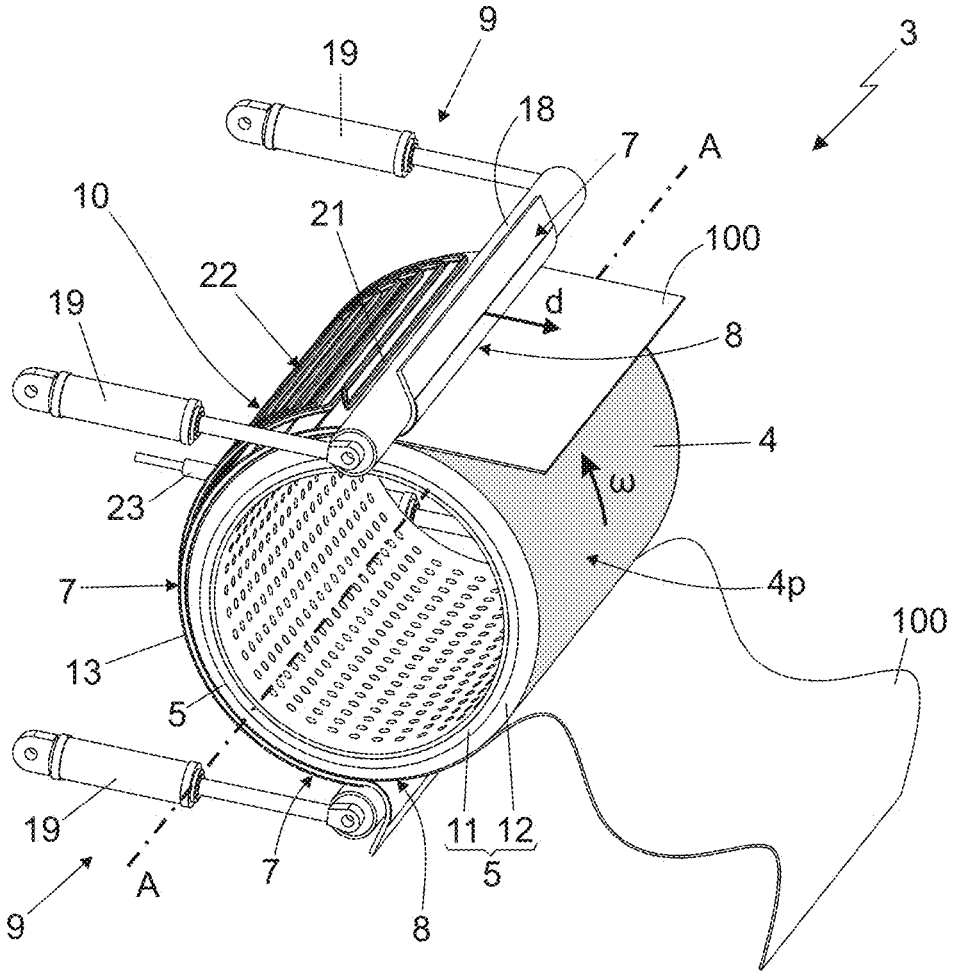
FIGS. 2 and 3 are simplified perspective views of the ironing assembly of the ironing machine shown in FIG. 1, with parts removed for clarity.
Figure 3:
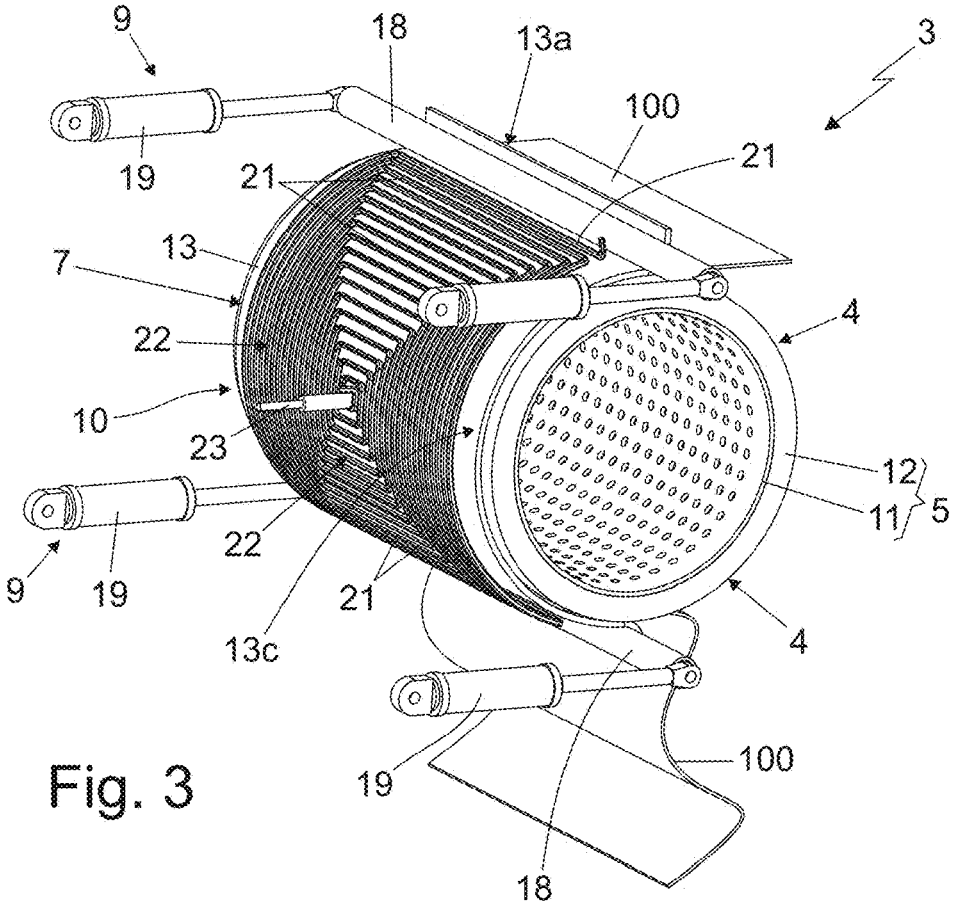
Figure 4:
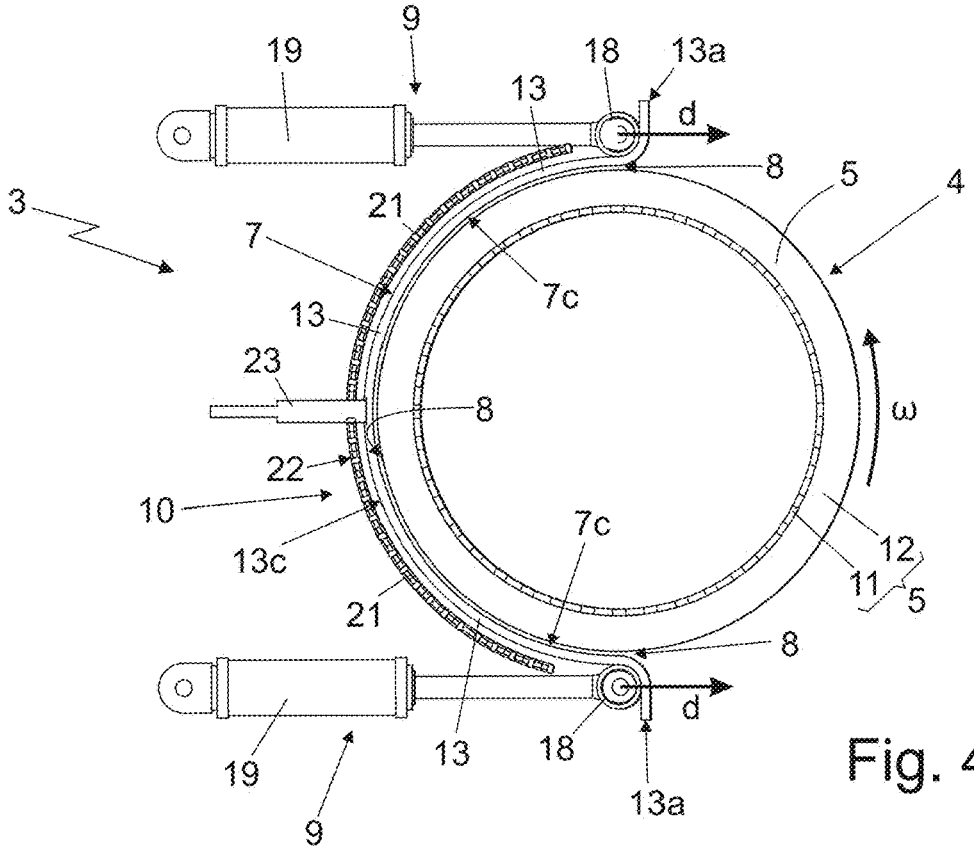
FIG. 4 is side view of the ironing assembly shown in FIGS. 2 and 3, sectioned along the transversal midplane of the ironing assembly.

With reference to FIGS. 2, 3 and 4, the supporting assembly 9, in turn, is preferably structured to directly support and elastically keep the two longest opposite longitudinal edges 13*a* of platelike member 13, i.e. the edges of platelike member 13 parallel to longitudinal axes A and L on diametrically opposite sides of the ironing drum 4, so as to allow a limited radial displacement of platelike member 13 with respect to ironing drum 4.

Preferably, the supporting assembly 9 is furthermore structured to selectively push the two longest longitudinal edges 13*a* of platelike member 13 in a direction "d" locally substantially tangent to the peripheral surface 4*p* of ironing drum 4 and perpendicular to the longitudinal axis A of ironing drum 4, so as to press the whole C-bent platelike member 13 against the peripheral surface 4*p* of ironing drum 4 or vice versa.

More in detail, in the example shown each longest longitudinal edge 13*a* of platelike member 13 is preferably rigidly coupled/attached to a straight longitudinal stiffening bar 18 that extends parallel to the longitudinal axis L of platelike member 13, locally substantially adjacent to the peripheral surface 4*p* of ironing drum 4; and supporting assembly 9 is preferably structured to elastically support both stiffening bars 18 of ironing chest 7.

With reference to FIGS. 2, 3 and 4, in the example shown, the supporting assembly 9 preferably comprises, for each stiffening bar 18, one or more, preferably a pair of, reciprocally parallel, pressurized cylinders 19 that extend substantially perpendicular to the stiffening bar 18 and to the longitudinal axes A and L, and are preferably interposed between the outer casing 2 and the two axial ends of the stiffening bar 18 so as to be able to move the stiffening bar 18 back and forth in displacement direction d.

Lastly, with reference to FIGS. 2, 3 and 4, the induction device 10 is preferably faced to the convex face 13*c* of platelike member 13, i.e. to the ferromagnetic layer 15 of platelike member 13, and preferably basically comprises: at least one electrical conductor 21 which is shaped/arranged so as to form one or more induction coils 22 (one induction coil 22 in the example shown) which is/are located immediately adjacent to the convex face 13*c* of platelike member 13; and an electric power unit (not shown in the figures) which is electrically connected to said electrical conductor/s 21 and is adapted to circulate, on command and along the electrical conductor/s 21, an high-frequency alternating current (i.e. an AC current with a frequency higher than standard mains frequency), so that each of said one or more induction coils 22 generates a high-frequency electromagnetic field that affects the adjacent platelike member 13 of ironing chest 7. This high-frequency electromagnetic field, in turn, generates inside the ferromagnetic layer 15 of platelike member 13, via electromagnetic induction, high-frequency Eddy currents that quickly heat up the whole platelike member 13 via Joule heating.

More in detail, the electric power unit is preferably adapted to circulate, along the electrical conductor/s 21, an alternating current with a frequency ranging between 20.000 Hz to 40.000 Hz.

Preferably, the induction device 10 comprises a temperature sensor 23 which is preferably arranged in abutment against the ironing chest 7, or better against the platelike member 13 of ironing chest 7, and is capable of detecting and communicating the current temperature of the ironing chest 7.

The electric power unit (not shown in the figures), in turn, is preferably electronically connected to the temperature sensor 23 and is preferably configured to power said one or more induction coils 22 so as to bring and keep the platelike member 13 of ironing chest 7 at the said ironing temperature.

In addition to the above, the aforesaid electric power unit (not shown in the figures) can be preferably directly controlled or simply activated by an appliance main electronic control unit (not shown in the figures) which is preferably located inside the outer casing 2 and, in turn, is preferably electrically connected to an appliance control panel 24 which is preferably located on a front wall of outer casing 2, preferably horizontally beside the exposed portion of ironing drum 4, and is preferably structured for allowing the user to manually select some operating parameters of the ironing machine 1.

More in detail, with particular reference to FIGS. 2, 3 and 4, in the example shown the threadlike electrical conductor 21 is preferably shaped/arranged so as to form a preferably approximately rectangular-shaped, platelike spiral coil 22 which is preferably slightly C-bent so as to extend locally substantially parallel to nearly the whole convex face 13*c* of platelike member 13.

The electric power unit, in turn, preferably includes a traditional AC/AC power inverter which is capable of converting the standard current, voltage and frequency of the electric power supplied by the external electricity network into the appropriate current, voltage and frequency adapted to be supplied to the one or more induction coils 22 of induction device 10.

Finally the temperature sensor 23 is preferably arranged in abutment on the convex face 13*c* of platelike member 13, preferably nearly in the middle of the same convex face 13*c*.

General operation of ironing machine 1 is almost identical to that of chest ironers currently on the market, thus no further information are required.

As regards instead the ironing chest 7, production of platelike member 13 preferably comprises the steps of:

rolling a single aluminium sheet, for example made of Aluminium 1050, from a flat shape to a nearly half-cylinder so as to form the supporting sheet 14; and applying a ferromagnetic metal material with a thermal conductivity significantly lower than that of the aluminium, for example AISI 430 steel, on the convex face of supporting sheet 14, preferably via a cold-spray deposition process, so as to form the rear ferromagnetic layer 15.

Preferably, production of platelike member 13 additionally comprises the step of:

anodizing the concave face of supporting sheet 14 so as to form the front protective film 16.

The advantages connected to the particular multilayer structure of platelike member 13 are noteworthy and large in number.

First of all, experimental tests revealed that, if supporting sheet 14 is made of a diamagnetic or paramagnetic metal material, for example aluminium or aluminium alloys, having a thermal conductivity higher than that of the ferromagnetic metal material forming the rear ferromagnetic layer 15, the differences in the temperature distribution over the whole surface of the concave outer surface 7*c* of platelike member 13 are almost close to zero, with all advantages that this entails in the ironing process.

Furthermore, the particular stripped design of ferromagnetic layer 15 highly improves the flexibility of platelike member 13, thus allowing the ironing chest 7 to better cope with the peripheral surface of ironing drum 4 and to quickly adapt its shape to the laundry item 100 laying over the peripheral surface of ironing drum 4.

Finally, forming the ferromagnetic layer 15 on the convex face of supporting sheet 14 via a cold-spray deposition process allows to independently size each layer of the platelike member 13 irrespective of the others, thus allowing to perfectly tailor the thickness of ferromagnetic layer 15 to the electromagnetic induction capabilities of induction device 10 while reducing at same time the overall production costs.

Clearly, changes may be made to the ironing machine 1 without, however, departing from the scope of the present invention.

For example, as an alternative to aluminium or aluminium alloys, the supporting sheet 14 may be made of copper or copper alloys having a thermal conductivity preferably roughly equal to or higher than 390 W/(m·K) (watts per meter-kelvin).

Moreover, according to a non-shown alternative embodiment, the electrical conductor/s 21 of induction device 10 may be shaped/arranged so as to form a number of adjacent platelike spiral coils 22 each of which extends locally substantially tangent to a respective portion of the convex face 13*c* of platelike member 13.

The invention claimed is:

1. An ironing machine comprising: an axially-rotatable ironing drum; a motor assembly adapted to drive the ironing drum into rotation about a drum longitudinal axis; an ironing chest arranged adjacent to the ironing drum, locally substantially parallel to a peripheral surface of said ironing drum; a supporting assembly adapted to keep the ironing drum and the ironing chest adjacent to one another; and an induction device located adjacent to the ironing chest and adapted to heat up, via electromagnetic induction, the ironing chest;

said ironing chest comprising a platelike member which extends beside the ironing drum, and is substantially C-bent so as to extend locally substantially parallel to the peripheral surface of said ironing drum;

wherein said platelike member has a multilayer structure that includes: a main supporting sheet which is substantially C-bent and is made of a first metal material having a given thermal conductivity; and a ferromagnetic layer which covers a convex face of said main supporting sheet, and is made of a ferromagnetic second metal material having a thermal conductivity lower than that of said first metal material.

2. Ironing machine according to claim 1, wherein said first metal material has a thermal conductivity higher than 230 W/(m·K).

3. Ironing machine according to claim 1, wherein said first metal material is a diamagnetic or paramagnetic metal material.

4. Ironing machine according to claim 1, wherein said first metal material is aluminium or an aluminium alloy.

5. Ironing machine according to claim 1, wherein the second metal material has a thermal conductivity which is at least 50% lower than that of the first metal material, and/or is lower than 100 W/(m·K).

6. Ironing machine according to claim 1, wherein the thickness of said ferromagnetic layer is lower than that of said main supporting sheet.

7. Ironing machine according to claim 6, wherein the thickness of said ferromagnetic layer is at least 50% lower than that of said main supporting sheet.

8. Ironing machine according to claim 1, wherein said second metal material is AISI 430 steel or other ferromagnetic metal alloy having a thermal conductivity ranging between 15 and 50 W/(m·K).

9. Ironing machine according to claim 1, wherein the ferromagnetic layer is formed/realized directly onto the convex face of the main supporting sheet via a cold-gas dynamic-spray deposition process.

10. Ironing machine according claim 1, wherein the ferromagnetic layer includes a series of discrete and reciprocally spaced, longitudinal ferromagnetic stripes or splints which are made of said second metal material, and extend on the convex face of said main supporting sheet spaced side-by-side to one another.

11. Ironing machine according to claim 10, wherein said longitudinal ferromagnetic stripes or splints extend on the convex face of said main supporting sheet substantially parallel to a longitudinal axis of said platelike member.

12. Ironing machine according to claim 1, wherein said platelike member additionally includes a protective film which covers a concave face of said main supporting sheet, and is made of an abrasion- and/or corrosion-resistant coating material.

13. Ironing machine according to claim 12, wherein said protective film is obtained by anodizing the surface of the concave face of said main supporting sheet.

14. Ironing machine according to claim 1, wherein said platelike member is substantially hemicylindrical in shape.

15. Ironing machine according to claim 1, wherein said induction device comprises: at least one electrical conductor which is shaped/arranged so as to form one or more induction coils which is/are located adjacent to the convex face of said platelike member; and an electric power unit which is electrically connected to said electrical conductor/s and is adapted to circulate, along said electrical conductor, a high-frequency alternating current.

* * * * *